US007306392B2

(12) United States Patent
Mislove

(10) Patent No.: US 7,306,392 B2
(45) Date of Patent: Dec. 11, 2007

(54) WATER IRRIGATED AND ARTICULATED SHOWERHEAD ATTACHMENTS

(76) Inventor: Bradley Mislove, P.O. Box 11913, Marina del Rey, CA (US) 90295

( * ) Notice: Subject to any disclaimer, the term of this patent is extended or adjusted under 35 U.S.C. 154(b) by 0 days.

(21) Appl. No.: 11/177,542

(22) Filed: Jul. 8, 2005

(65) Prior Publication Data

US 2005/0241664 A1 Nov. 3, 2005

Related U.S. Application Data

(63) Continuation-in-part of application No. 10/659,520, filed on Sep. 10, 2003, now Pat. No. 7,007,390.

(51) Int. Cl.
*A46B 11/00* (2006.01)
*A46B 11/06* (2006.01)

(52) U.S. Cl. ..... 401/289; 401/290

(58) Field of Classification Search ..... 401/6, 401/268, 289, 290, 291
See application file for complete search history.

(56) References Cited

U.S. PATENT DOCUMENTS 4,171,169 A * 10/1979 Williams ..... 401/41
4,581,785 A * 4/1986 Suzuki ..... 15/21.1
6,530,707 B1 * 3/2003 Byrne et al. ..... 401/6
6,997,632 B1 * 2/2006 Adams ..... 401/289

* cited by examiner

*Primary Examiner*—David J. Walczak
(74) *Attorney, Agent, or Firm*—Michael Bak-Boychuk

(57) ABSTRACT

An irrigated personal care structure defined by a resilient, hollow handle terminating in a mounting interface conformed to selectively engage a transverse razor head provided with a slot wherein razor blades are mounted and exposed to the water flow conveyed through the handle or a hollow brush head similarly irrigated by the water flow. The surfaces of the handle subjacent the interface folded into adjacent accordion folds which in response to pressure pulses in the handle articulate the article mounted on the interface. Either a pulsating shower head branched from the water flow to the handle or a water pulsing mechanism directly in the flow provide the necessary pressure fluctuations.

7 Claims, 5 Drawing Sheets

WATER IRRIGATED AND ARTICULATED SHOWERHEAD ATTACHMENTS

REFERENCE TO RELATED APPLICATIONS

This application is a continuation in part of U.S. patent application Ser. No. 10/659,520 filed on Sep. 10, 2003, now U.S. Pat. No. 7,007,390, and the benefit of this earlier filing date is claimed for all matter common therewith.

BACKGROUND OF THE INVENTION

1. Field of the Invention

The present invention relates to shaving devices, and more particularly to water irrigated shavers modulated in their shaving contact by pulsations in the water stream.

2. Description of the Prior Art

The early morning shower ablution followed by a shave is a well practiced process now wholly imbedded in our everyday life. Even our colloquial discourse includes reference to the proverbial "quick shower and shave" fixing the association of the shower with a subsequent shave. This traditional morning sequence is thus virtually universal as the physics that governs this sequence rest on shaving convenience of the prior day's beard growth that has been first well soaked in the shower. Our colloquial expression simply recognizes that a close shave is much more easily obtained if the face is first well moistened. Of course, one also desires that the same time economies also extent to the task of brushing one's teeth often finished right in the shower.

In the past various mechanisms have been devised which recognize the physical relationship of these habituated events, particularly those that and in one way or another irrigate the shaving head with household water flow. The teachings of U.S. Pat. No. 4,633,585 to Whitaker, et al., for example, illustrate one such structure in which the household water supply is conveyed by flexible tubing to irrigate both the shaved surface and also the shaving edges. Other similar examples can be found in U.S. Pat. No. 4,228,586 to Thierry; U.S. Pat. No. 5,177,870 to Jursich, et al.; U.S. Pat. No. 5,402,574 to Milner; U.S. Pat. No. 6,305,082 to Troncoso; and others. Each of the foregoing, while suitable for their purpose, fail to address the coincident steam and moisture that is associated with the irrigation and that also limits the usefulness of a mirror therewith. The user of such irrigated devices is therefore left more or less blind while shaving in the shower and the efficacy of the shaving stroke is therefore a major concern.

Reliance on manual dexterity and control while manipulating a sharp instrument in the steamy confines of a shower and in the consequent absence of all visual feedback is a brave undertaking. For these reasons the prior art irrigated shavers have had less than full acceptance in the marketplace. Instead water impervious motorized shavers appeared on the market, preferring the safety of a small motorized stroke over the manual strokes of a blade edge. Water impervious electric shavers, however, are inherently expensive to produce and alternatives therefor have been universally sought. A passive irrigated shaving arrangement utilizing water pressure fluctuations to excite small blade modes of motion can effectively combine the safety of a small shaving stroke with the convenience of unpowered in-shower use and it is one such arrangement that has been instantly developed in a structure that is also useful to reciprocate a brush. Thus the same mechanism can be effectively adapted both for in-shower shaving and also for use as a powered tooth brush.

SUMMARY OF THE INVENTION

Accordingly, it is the general purpose and object of the present invention to provide a resilient brush structure articulated by oscillatory motion induced by pressure pulsations in the water flow.

Other objects of the invention are to provide a brush structure conformed for connection to a household water supply having developed therein a pulsed flow.

Yet further objects of the present invention are to conform an irrigated brush structure reciprocated by oscillatory motion response induced by pressure fluctuations in the irrigating flow.

Briefly, these and other objects are accomplished within the first implementation of the present invention by providing a safety razor assembly with a hollow handle connected at one end to a flexible conduit that is then selectively securable at its other end to a branching outlet of a diverter valve interposed between the shower outlet and a shower pulsating spray head on the other diverter branch. The other end of the hollow handle, in turn, connects to a hollow shaving head provided with an exit slot in which one or more shaving blades are mounted, the connection between the handle and the head being formed as an eccentrically convolved surface conformed to impart small pivotal motions to the head in response to pressure fluctuations within the handle interior. The coincidence of these small pivotal blade motions with each pressure pulse then effects small blade translations over the shaved skin surface that is concurrently under increased irrigation pressure, promoting smooth and effective shaving.

It will be appreciated that these same eccentric surface convolutions that impart the arcuate shaving strokes of the razor blades can also articulate other devices, as for example a tooth brush that may be mounted onto the hollow handle in substitution for the razor head. To effect this substitution both the razor head and the tooth brush attachment are formed as separate structures keyed or otherwise secured to the convolved handle in the course of the use of the shower. To further advance their use convenience the attachable tooth brush head may be filled with tooth paste that will be then expelled through openings adjacent the brush fibers that thereafter irrigate the brush fibers once the tooth paste is consumed and, similarly, the razor head may also be filled with shaving soap, cream or other moisturizing and lubricating matter to be then discarded once it is consumed. Thus both the razor head and the tooth brush attachment can be fabricated as a single use article to be then discarded, an attribute of particular convenience to the traveling public and their lodging providers.

In further alternative, both the tooth brush attachment and the razor assembly may be formed as integral structures each including its own handle portion with the wall convolutions of the tooth brush handle distributed symmetrically about its longitudinal axis to produce an axially reciprocating stroke in response to internal pressure fluctuations. Both structures may then be provided with internal storage chambers from which either the shaving cream or the tooth paste are dispensed at the selection of the user. In this form the plural use attributes of the tooth brush bristle and the razor blade are fully realized, reducing inventory burden. Of course, known quick engagement techniques can be utilized for the device engagement along with the shower head connection variants described below, including those where the pressure fluctuations in the pulsating shower head to produce the reflected pulse pressure in the other diverted branch connected to the inventive shaver. More precisely, a pulsing shower head is usually associated with substantial pressure drops and it is the manual adjustment of these pressure levels that determines the pulse pattern selected. The user thus has substantial control over the amount of the irrigating flow and the pulse pattern by the simple expedient of the diverter valve opening and the selection of the pattern on the shower head.

Of course, for those installations not equipped with a pulsating shower head a pulse adapter can be provided for attachment directly to the end of the hollow shaver handle and implemented in a manner like the pulse generating mechanism of a shower head. This adapter may be vended separately or as part of a combination including the diverter valve, the flexible hose and the inventive irrigated shaver, and may also include various flow rate restrictors useful in accommodating any local water conservation directives. In this manner the full range of shower variants is accommodated in a single vended array.

DESCRIPTION OF THE PREFERRED EMBODIMENTS

Figure 1:
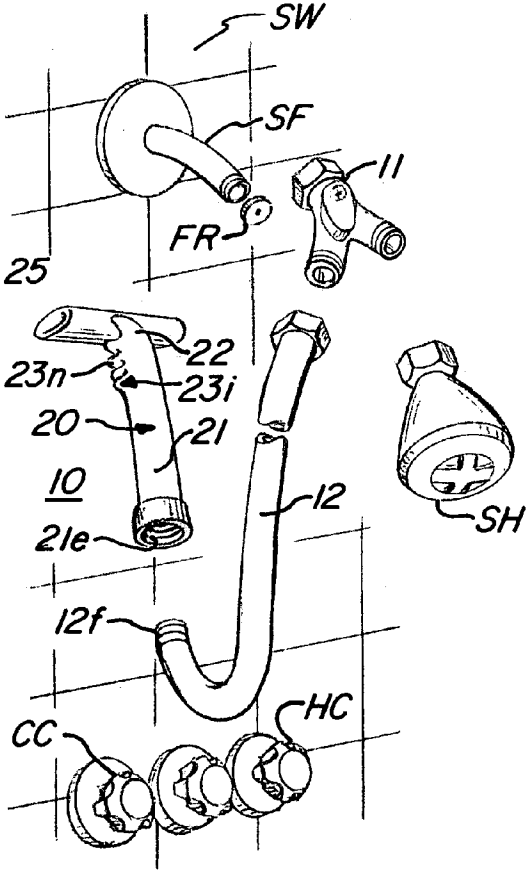
FIG. 1 is a perspective illustration, separated by parts, of the inventive shaving assembly conformed for use with a pulsating shower head.

As shown in FIGS. 1-4 the inventive irrigated razor shower assembly, generally designated by the numeral 10, is conformed for deployment from a conventional household shower facility including a shower head fitting SF extending to the exterior of a shower wall SW from a delivery pipe DP mounted within the wall and connected at its other end both to a hot and cold water supply HW and CW respectively. In conventional practice manual control devices HC and CC are provided that extend again to the exterior of the shower wall, sometimes in the form of a single manual control device and on other occasions as a set of manual handles, and it is through these devices that the household user selects both the shower flow rate and its temperature. A conventional shower head SH threadably mounted on the end of fitting SF and sometimes fitted with a flow restrictor FR for conservation then dispenses the water flow as a spray onto the user, with the more current shower heads providing a pulsating flow pattern at adjustable pressure fluctuations.

Those skilled in the art will appreciate that the foregoing shower configuration is particularly conformed for interchange and replacement of the shower head SH by the household occupant and this replacement is a relatively frequent event in our everyday life. In consequence the threaded engagement of the shower head SH to the end of the outlet fitting SF is generally straight-forward, conveniently effected with minimal tools. This convenience is used to advantage in the course of installation of the inventive irrigated razor shower assembly 10 in which the shower head SH is first removed from the fitting SF and a diverter valve 11 is then inserted therebetween, with one of the two outlets of valve 11 thereafter re-engaging the shower head while the other outlet is then threadably engaged to one end of a flexible hose 12. Of course, any flow restrictors FR that may have been deployed in the shower head inlet are then re-inserted between the fitting SF and the corresponding inlet of the diverter valve 11 to restore the conservation features earlier installed both through the shower head SH and the flexible hose 12.

The other free end 12*f* of flexible hose 12 is then available for threaded insertion into the end opening 21*e* of a hollow handle 21 forming the inventive irrigated razor 20 formed of a polymeric material structure that is generally elastically resilient. The other end of handle 21 then forms a bent neck portion 22 with the inside surface of the bend convolved in the manner of a plurality of accordion-like folds 21-*i* through 21-*n* that extend asymmetrically over a part of the inner circumference and as result of this asymmetric geometry impart an arcuate flexure response AR to neck 22 with internal pressure fluctuations. In consequence, a hollow shaving head 25 cantilevered from the neck 22 is also articulated by small articulations AU and AD in the up and down directions respectively. Of course, these up and down articulations correspond directly to an increase and decrease in the in the razor's internal pressure. A set of shaving blades 27 and 28 installed in an end slot 26 of the shaving head 25 is thus articulated in small up and down motions over the skin SK of the user.

It will be appreciated that the pressure fluctuations within razor 20 are a reflection of the flow rate selected by the controls HC and CC, the pressure fluctuations in the shower head SH, the manual setting of diverter valve 11 and the flow restriction through slot 26. The user, therefore, has the full range of controls to select the pressure pulse and the irrigating flow over blades 27 and 28, thus controlling the lubricating irrigation flow pressure against the skin SK during the upward stroke AU. The reduced pressure that then follows allows a further inward extension of the local skin SK into slot 26, resulting in a closer shave stroke in the direction AD. In this manner a convenient stroke articulation is provided that, because of the very limited dimensions of the pressure induced stroke, requires little visual assistance. Thus an inexpensively fabricated hollow razor assembly effectively duplicates the conveniences of a water impervious motorized shaver, providing the further conveniences of easy replacement of those parts of the array that become dull with use.

Figure 5:
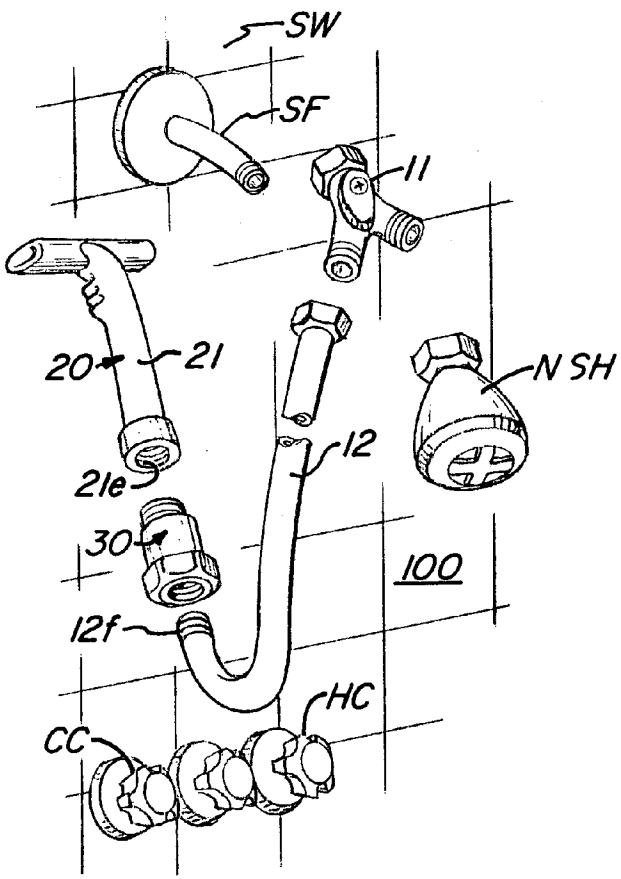
FIG. 5 is yet another perspective illustration, separated by parts, of the inventive shaving assembly conformed for use with an even flow shower head.
Figure 4:
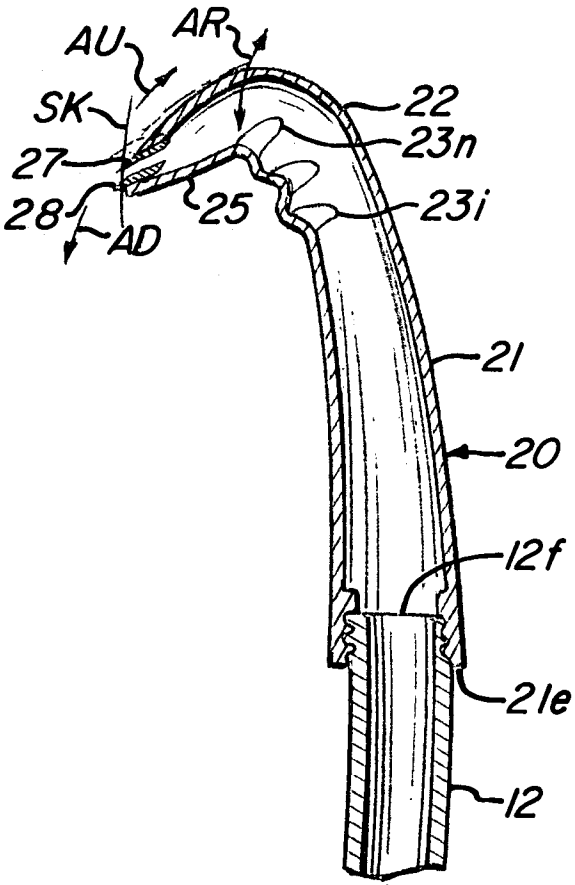
FIG. 4 is a sectional side view taken along line 4-4 of FIG. 2.
Figure 2:
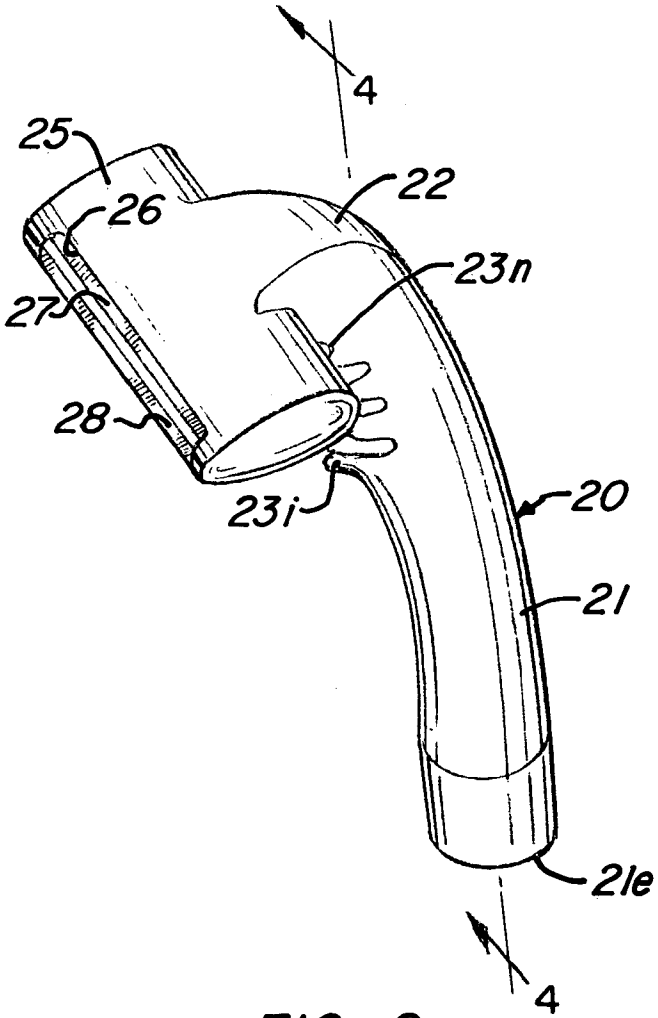
FIG. 2 is yet another perspective illustration of the inventive irrigated shaver useful in the assembly combination shown in FIG. 1 and in other combinations.
Figure 6:
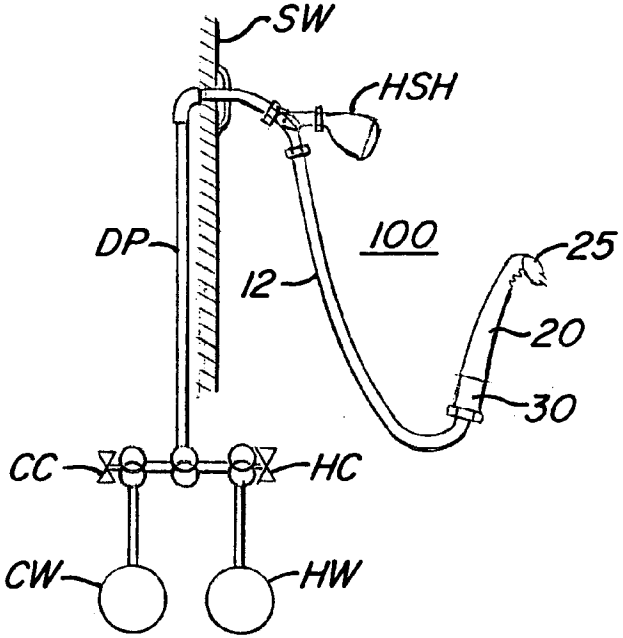
FIG. 6 is a further flow diagram illustrating the water flow conveyances and paths within the inventive assembly shown in FIG. 5.
Figure 3:
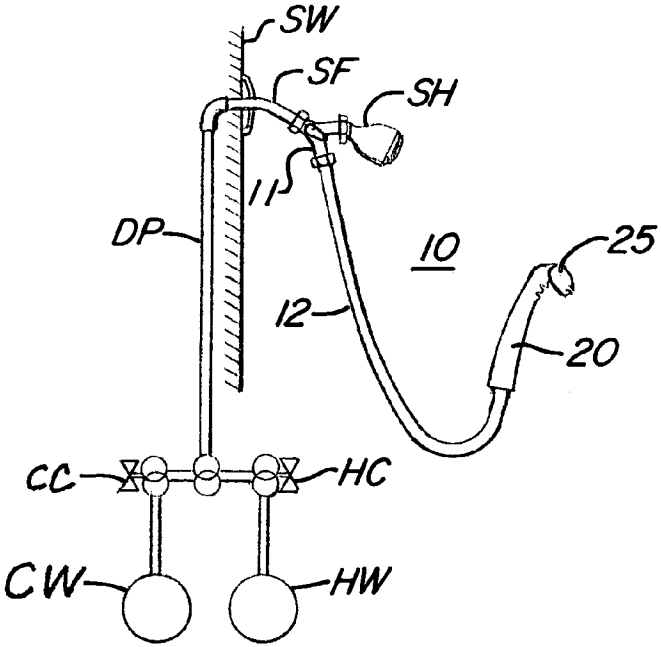
FIG. 3 is a flow diagram illustrating the water flow conveyances and paths within the inventive assembly shown in FIG. 1.

While the foregoing description illustrates the operative aspects of the invention in conjunction with a pulsating shower head SH those skilled in the art will appreciate that similar advantages can be obtained by way of a pulse mechanism 30 between hose 12 and handle 21. By particular reference to FIGS. 5 and 6, wherein like numbered parts function in like manner to that previously described, the inventive shaving assembly 100 may be utilized with a non-pulsing shower head NSH which again is mounted on one branch of diverter valve 11. The other branch, as before, is connected to the flexible hose 12 that then threads at its free end 12*f* to the pulse mechanism 30 and it is the pressure modulated output of the pulse mechanism that then feeds directly into the end opening 21*e* of handle 21. The inventive irrigated razor assembly 20 then operates again in the above manner.

In both implementations the water pressure pulsing mechanism itself may be conformed in accordance with well known teachings in the prior art. For example both the shower head SH and the pulse mechanism 30 may be implemented in a manner like that described in U.S. Pat. No. 4,089,471 issued to Koenig on May 16, 1978 in which balls spaced by circular segments are rotated inside an annular cavity to periodically interrupt the water flow though an opening, or alternatively according to the teachings of U.S. Pat. No. 4,081,135 issued to Tomaro on Mar. 28, 1978 wherein a water driven turbine periodically advances vanes across the water jet to open and close the water flow therethrough. These and similar teachings are well known in the art, each in one manner or another resulting in a pulsating water flow which either directly, or by reflection, then produces the pressure pulses in the irrigated razor 20.

Figure 7:
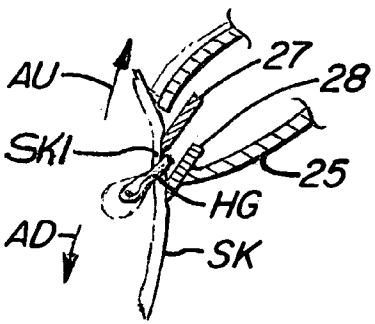
FIG. 7 is a detail illustration, in section, of the coordination of the inventive razor stroke with the local skin deformation.

By particular reference to FIG. 7, those skilled in the art will appreciate that the downward articulation AD of the razor head and the blades mounted therein is associated with a reduction in internal pressure and therefore an extension of the skin SK into an outwardly bulging skin distortion SKI to provide a more intimate contact with the blade edges and therefore a deeper incision into the hair growth HG. Of course, while these effects are both enlarged and exaggerated in the instant illustration this stepwise articulation of the blades in coordination with the pressure pulse results in a closer shave and also one that requires less visual attention because of the small dimensional limits of the strokes AU and AD. In this manner a safe and effective razor is devised that is wholly useful in a shower.

Figure 8:
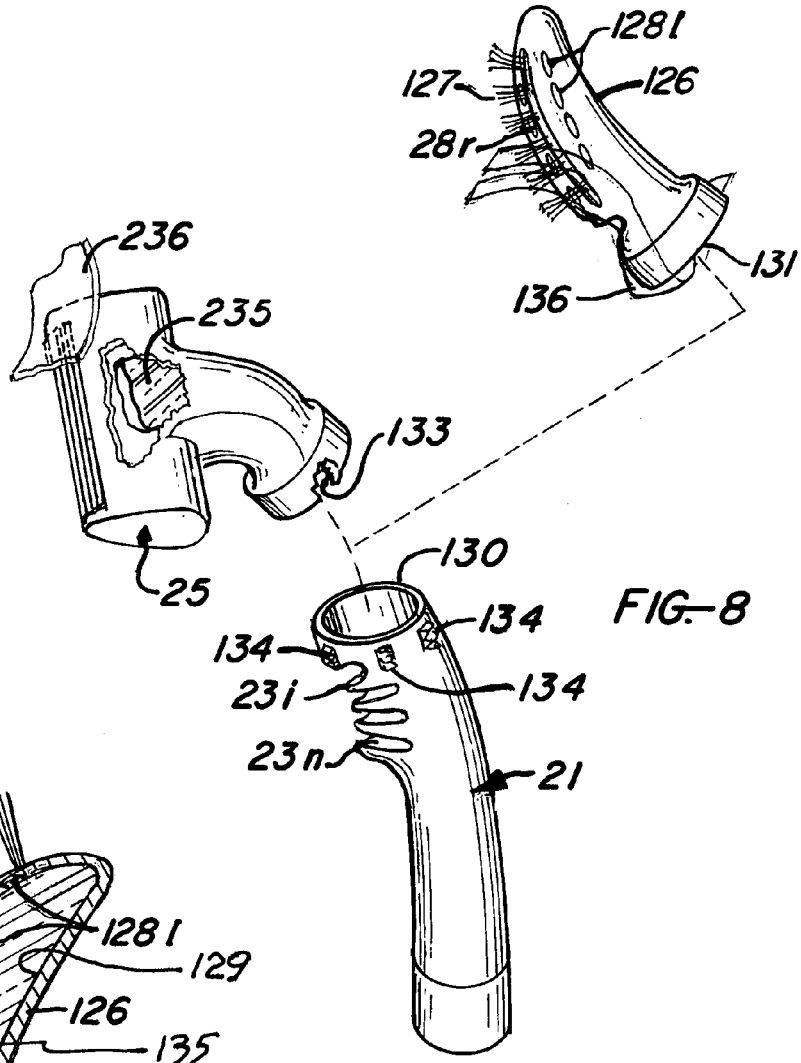
FIG. 8 is a further perspective illustration of an alternative structural arrangement wherein a removable razor head may be exchanged for a tooth brush attachment.
Figure 9:
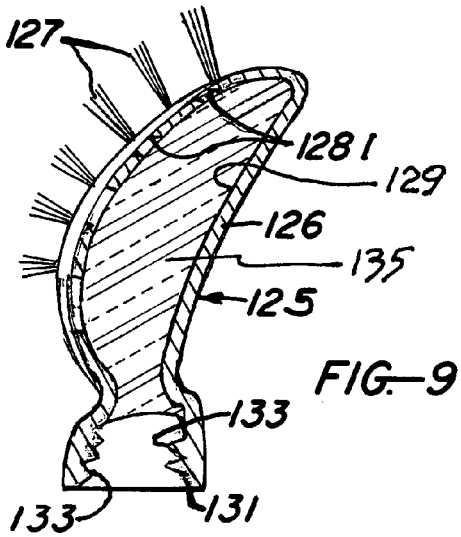
FIG. 9 is a perspective detail illustration, in partial section, of the inventive tooth brush attachment shown in FIG. 8.

While the foregoing teachings are primarily focused on the use of a pulsating water stream to articulate a resilient razor assembly 20, it will be appreciated that other devices may be similarly implemented, particularly articles that offer other cleansing assistance in the course of a shower. Like numbered parts functioning in like manner to that previously described, one such article may be a reciprocated brush attachment, generally designated by the numeral 125, that may be useful in the cleaning one's teeth and which may be mounted in substitution for the razor head 25. By particular reference to FIGS. 8 and 9 this interchange is effected by modifying the hollow handle 21 to include a keyed interface 130 at the juncture of the shaving head 25 with the neck portion 22 with the brush attachment 125 then similarly provided with a conformingly shaped base opening 131 to mate at the interface. Attachment 125 is generally defined as a hollow shell 126 that extends from the base opening 131 as an elongated arcuate enclosure provided with a bristle row or comb 127 aligned exteriorly along the spine of the shell 126 and flanked on each side by a row of openings 128*l* and 128*r*. A quantity of tooth paste 135 then fills the interior cavity 129 of the shell 126 sealed in place by a removable tape 136 that covers both the base opening 131 and the opening rows 128*l* and 128*r*.

In this form the brush attachment 125 is engageable by its base opening 131 to the interface 130 once the tape 136 is peeled off. Thereafter the water pressure through the hollow handle 21 then expels the tooth paste 135 through the opening rows 128*l* and 128*r* while the pressure fluctuations articulate interface 130 along with the bristle comb 127 assisting in the cleaning of the teeth of the user. Once the paste is fully expelled the water flow through the openings rinses the user's mouth while finishing the tooth brushing process and upon its completion the attachment may be discarded. It will be appreciated that since the handle 21 includes eccentrically disposed convolutions 23*i* to 23*n* the resulting articulation by pressure of interface 130 is along the arc AR and to compensate partly therefore the bristle comb 127 is similarly arched to impart a generally linear reciprocation of the bristle ends. It will, of course, be further appreciated that the water rinsing and paste expelling parts of this process entail differing fluid viscosities and therefore greater internal pressure excursions while there is still a remainder of the higher viscosity paste, thereby providing a more vigorous stroke when the paste is being expelled while also informing the user of each stage of the sequence. In a similar fashion the shaving head 25 may be filled with a quantity of shaving soap 235 and thereafter enclosed by a removable tape 236 right prior to use. Again the differing fluid viscosities produce differing articulations so that the soap application part of the sequence is perceptibly different from the shaving articulation.

While there are many ways to engage the shaving head 25 or the brush attachment 125 in each instance both may include circumferentially spaced barbed rows 133 which on partial rotation relative the interface 130 engage corresponding interior barb rows 134. In this manner inexpensive and therefore discardable article may be provided to render convenience for those away from their home.

Figure 10:
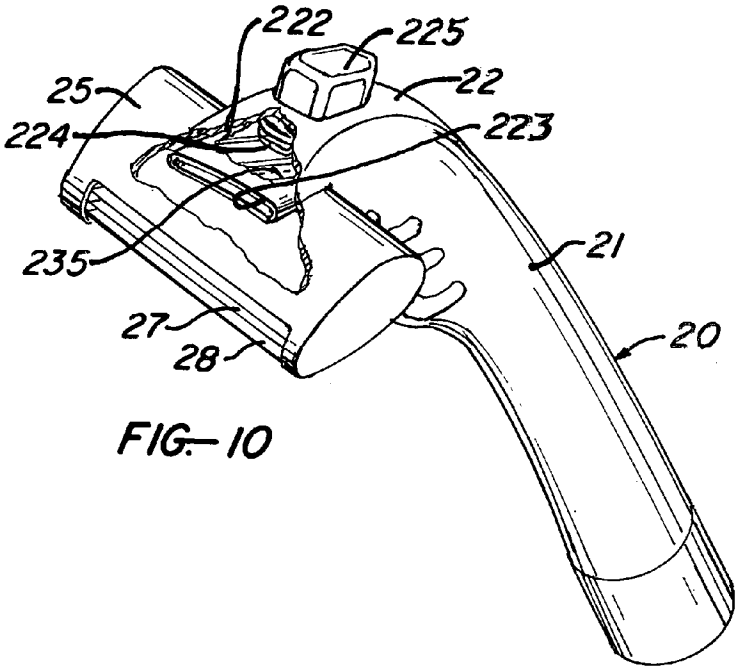
FIG. 10 is a further sectional view of an alternative razor assembly provided with a storage cavity from which shaving cream may be dispensed.

For those applications where more than a single use is desired modifications of the irrigated razor 20 illustrated in FIG. 10 may be effected to include a manually articulated plunger 225 extending through the outer surface of neck 22 into a flexible chamber 222 formed in the razor head 25. Chamber 222 may be filled with a quantity of shaving cream 235 trapped against a reed opening 223 aligned behind the razor blades 27 and 28 and in front of the interior end of plunger 225 so that a part of the soap is expelled into the space between the blades by each inward articulation of the plunger against its return spring 224. Once thus positioned the soap is then advanced through the blade gap onto the surface being shaved by the irrigating water flow.

Figure 11:
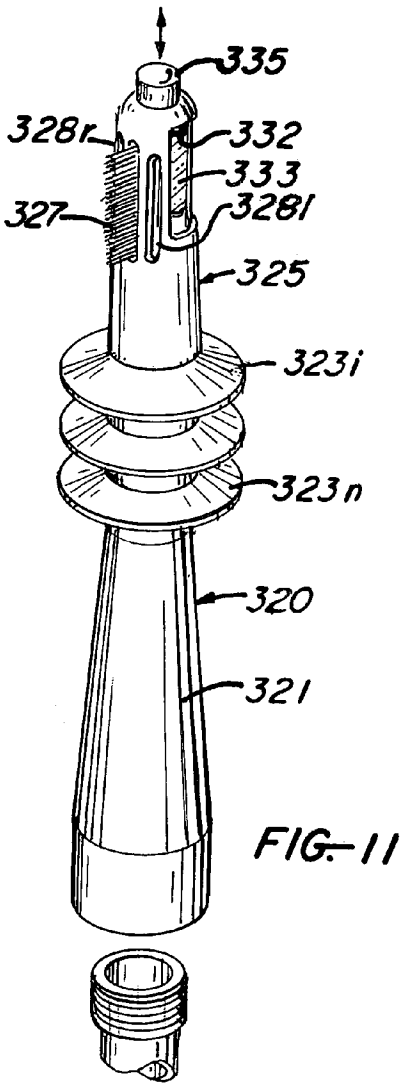
FIG. 11 is a perspective illustration, in partial section, of a tooth brush assembly useful in substitution for the razor assembly shown in FIG. 10.

By reference to FIG. 11 a multiple use articulated tooth brush assembly, generally designated by the numeral 320, may be similarly implemented to include a hollow handle 321 conformed for releasable attachment to the end of the flexible hose 12 (or any other source of pulsated water flow) in substitution for the irrigated razor. At the other end the walls of handle 321 are convolved into symmetrically disposed convolutions 323*i* through 323*n* in an accordion-like stack of surface folds that respond to the internal pressure in the handle by their axial spacing. A brush head 325 formed on the end of the convolutions is thus axially articulated reciprocating linearly a longitudinal bristle comb 327 extending between flanking rows of openings 328*l* and 328*r*.

Similar to the shaving cream dispensing arrangement described above, brush head 325 may include an internal chamber 332 filled with a quantity of tooth paste, tooth cleaning jell, or like 333 and provided with a reed opening (not shown) through which the paste is first expelled by a spring opposed plunger 335. In the and thereafter carried with the pulsating flow. In the foregoing manner a variety of interchangeable cleaning and grooming utensils may be conveniently combined with the well known pulsating shower mechanisms now available.

Those in the art will appreciate that these and similar articles of convenience are particularly desired by those in the hotel business, particularly when the minimal fabrication costs entailed greatly increase the comfort of the traveling patron.

Obviously, many modifications and variations can be effected without departing from the spirit of the invention instantly disclosed. It is therefore intended that the scope of the invention be determined solely by the claims appended hereto.

It is claimed:

1. An irrigated brush assembly, comprising in combination:

a generally cylindrical hollow structure defined by a tubular handle communicating at one end thereof with the interior of an elongate hollow head, said head including a bristle comb extending longitudinally along the exterior thereof and an opening formed adjacent said comb, said handle including a plurality of surface folds deployed symmetrically about the axis thereof for producing an axial spacing response therebetween in response to pressure pulses within the interior of said handle; and water conveying means connected to the other end of said handle for conveying water at pulsating pressure thereto.

2. The irrigated brush assembly according to claim 1, further comprising:

a resilient storage cavity formed in the interior of said head conformed for storing a quantity cleaning matter therein, said cavity including a discharge passage aligned towards said opening in said head; and manual ejection means extending from the exterior of said head into said storage cavity for expelling a portion of said cleaning matter therefrom upon the manipulation thereof.

3. The irrigated brush assembly according to claim 2, wherein:

said folds are conformed as adjacently spaced accordion shaped surface deformations in the wall surface of said handle.

4. The irrigated brush assembly according to claim 3, wherein:

said conveying means further includes pressure modulating means for producing said pulses in the course of conveying said water to said handle.

5. An irrigated personal care assembly adapted to be connected to the water outlet for a shower head, comprising in combination:

a generally hollow tubular resilient handle structure terminating at one end thereof in an adaptor interface conformed for selective engagement to one of several personal care devices, said handle structure including a plurality of surface folds deployed eccentrically subjacent said adaptor interface for effecting flexing deformation of said handle in response to pressure pulses within the interior thereof;

a flexible water conveyance connected between the other end of said handle and a adapted to be connected to said shower water outlet;

means for producing pulsating water pressure within said conveyance and said handle connected thereto; and a hollow brush head conformed for selective engagement to said interface.

6. The irrigated personal care assembly according to claim 5, wherein:

said brush head includes a quantity of cleaning matter stored in the interior thereof and an opening for conveying said matter to the exterior of said brush head in response to said pulsating water pressure within said handle.

7. The irrigated personal care assembly according to claim 6, wherein:

said cleaning matter is retained in said brush head by a removable cover.

* * * * *